US007572038B2

(12) United States Patent
Kinnune et al.

(10) Patent No.: US 7,572,038 B2
(45) Date of Patent: Aug. 11, 2009

(54) RETROFIT CANOPY LUMINAIRE AND INSTALLATION METHOD

(75) Inventors: Brian L. Kinnune, Racine, WI (US); Wayne Guillien, Franksville, WI (US)

(73) Assignee: Ruud Lighting, Inc., Racine, WI (US)

( * ) Notice: Subject to any disclaimer, the term of this patent is extended or adjusted under 35 U.S.C. 154(b) by 32 days.

(21) Appl. No.: 11/855,540

(22) Filed: Sep. 14, 2007

(65) Prior Publication Data

US 2008/0084698 A1 Apr. 10, 2008

Related U.S. Application Data

(60) Provisional application No. 60/850,233, filed on Oct. 6, 2006.

(51) Int. Cl.
*F21V 15/00* (2006.01)

(52) U.S. Cl. ..... 362/365; 362/147; 362/364; 362/375; 248/318

(58) Field of Classification Search ..... 362/147, 362/364–366, 374, 375; 248/318
See application file for complete search history.

(56) References Cited

U.S. PATENT DOCUMENTS 4,199,803 A * 4/1980 Hunt, III ..... 362/147
7,191,993 B2 * 3/2007 Bobrowski ..... 248/318

* cited by examiner

*Primary Examiner*—Stephen F Husar
(74) *Attorney, Agent, or Firm*—Jansson Shupe & Munger Ltd.

(57) ABSTRACT

A retrofit canopy luminaire assembly adapted for downward illumination and having a housing with inwardly-directed ledges near the lower edges of the housing. The luminaire has at least two support brackets secured to at least one of the ledges; a face plate removably secured to the brackets on the lower side of the housing; and a hanging tether attached to one of the brackets and to the face plate. The face plate is adapted to hold lighting fixture components. When the face plate is removed from the brackets, the face plate hangs freely held by the tether to allow free access to the inside of the luminaire.

2 Claims, 12 Drawing Sheets

RETROFIT CANOPY LUMINAIRE AND INSTALLATION METHOD

RELATED APPLICATION

This application claims the benefit of U.S. Provisional Application No. 60/850,233 filed on Oct. 6, 2006, the contents of which is incorporated by reference herein in its entirety.

FIELD OF THE INVENTION

This invention is related generally to luminaires and more particularly, to both apparatus and method for retrofitting a canopy-mounted luminaire.

BACKGROUND OF THE INVENTION

Canopy-mounted lighting fixtures (luminaires) are often used to provide lighting in areas such as service stations, drive-through facilities such as banks, and other outdoor lighting environments which are generally lighted from above. The canopy-mounted luminaires often have a housing formed in box-like fashion with several elements of the fixture such as a lamp, a lens for directing the light and any other structure configured to hold or seal the lamp mounted on a flat plate (face plate) which is then fastened in place on the lower portion of the housing. Other components such as a transformer or ballast (if needed), wiring connectors, may be mounted on the underside of the plate to place them protected from the weather and out of sight inside the housing.

Various canopy-mounted lighting fixtures have been developed. Examples of such prior art fixtures are those disclosed in the following United States patents: U.S. Pat. No. 6,561,670 (Jongewaard, et al), U.S. Pat. No. 6,116,749 (Quiogue, et al.), U.S. Pat. No. 5,997,158 (Fischer, et al.) and U.S. Pat. No. 5,662,407 (Fischer, et al.).

Canopy-mounted lighting fixtures in the prior art have certain shortcomings and disadvantages to which this invention is addressed. In particular, the box-like housings are often installed in a manner such that it is economically advantageous or otherwise desirable to replace the functioning elements of the luminaire while retaining the fixture housing in place within a canopy structure. Thus, there is a need for a low-cost retrofit luminaire which is also simple to install and repair.

OBJECTS OF THE INVENTION

It is an object of this invention, to provide a retrofit luminaire assembly which overcomes certain problems and shortcoming of the prior art including those referred to above.

Another object of this invention is to provide a retrofit luminaire assembly where the functioning-elements of the luminaire can be replaced while retaining the fixture housing in place within the canopy structure.

Yet another object of this invention is to provide a retrofit luminaire assembly which is simple to install and repair and also cost-effective.

These and other objects of the invention will be apparent from the following descriptions and the drawings.

SUMMARY OF THE INVENTION

This invention is a retrofit luminaire assembly adapted for downward illumination and having a housing with inwardly-directed ledges near the lower edges of the housing. The apparatus is of the type including at least two support brackets secured to at least one of the ledges; a face plate removably secured to the brackets on the lower side of the housing, the face plate adapted to hold lighting fixture components; and a hanging tether attached to one of the brackets and to the face plate. When the face plate is removed from the brackets, the face plate hangs freely held by the tether to allow free access to the inside of the luminaire.

In certain preferred embodiments the hanging tether is a first hanging tether and further includes a second hanging tether attached to the other support bracket. It is preferable that the support brackets and hanging tethers are each secured to opposite ends of one side of the face plate.

Preferred embodiments for installation of the retrofit luminaire assembly adapted for downward illumination and having a housing with inwardly-directed ledges near the lower edges of the housing, comprise the steps of: providing at least two support brackets; securing the two support brackets to at least one ledge; providing a face plate adapted to hold lighting fixture components; providing at least one hanging tether; and securing the face plate to the brackets with the at least one tether such that the face plate hangs freely without further support during installation.

The term "downward" is used herein for convenience in describing the invention and aspects thereof, but does not in any way mandate usage of the apparatus in any orientation. In other words, "downward" is not limited by the direction of gravity. Thus, if a retrofit luminaire assembly as disclosed herein is oriented upward rather than downward, or in some laterally-oriented direction, the term "downward" subsumes such meanings. The term "downward" has been used since one important application for the inventive apparatus is the lighting of ground surfaces from vertical light poles. Note that the figures primarily show such "downward" direction as generally upward since visualization of the retrofit luminaire assembly is best viewed for clarity in such orientation.

DETAILED DESCRIPTION OF PREFERRED EMBODIMENTS

Figure 1:
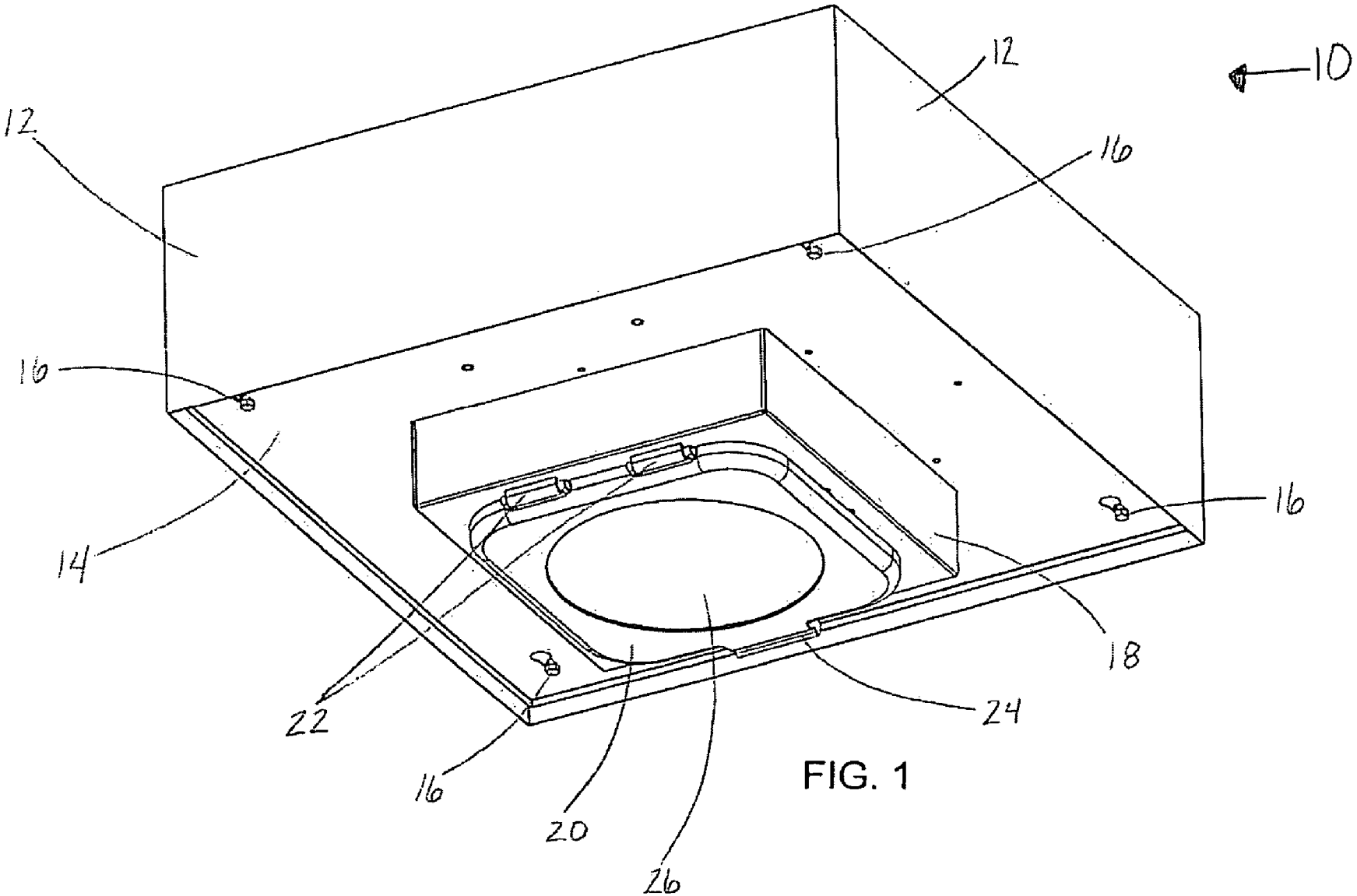
FIG. 1 is a perspective drawing of a preferred embodiment of the inventive retrofit luminaire.

FIG. 1 is a perspective drawing of a preferred embodiment of the inventive retrofit luminaire 10. Luminaire 10 includes a box-like housing 12 which is typically mounted on the underside of a canopy structure or ceiling (not shown) such that the light emanating from luminaire 10 is generally downward in direction. Luminaire 10 also includes a face plate 14 mounted on the underside of housing 12 with a set of fasteners 16 (four shown in FIG. 1) and a lamp component housing 18 with a hinged cover plate 20, two hinges 22, and a latch 24. Cover plate 20 includes a lamp lens 26 through which light from luminaire 10 emanates.

Figure 2:
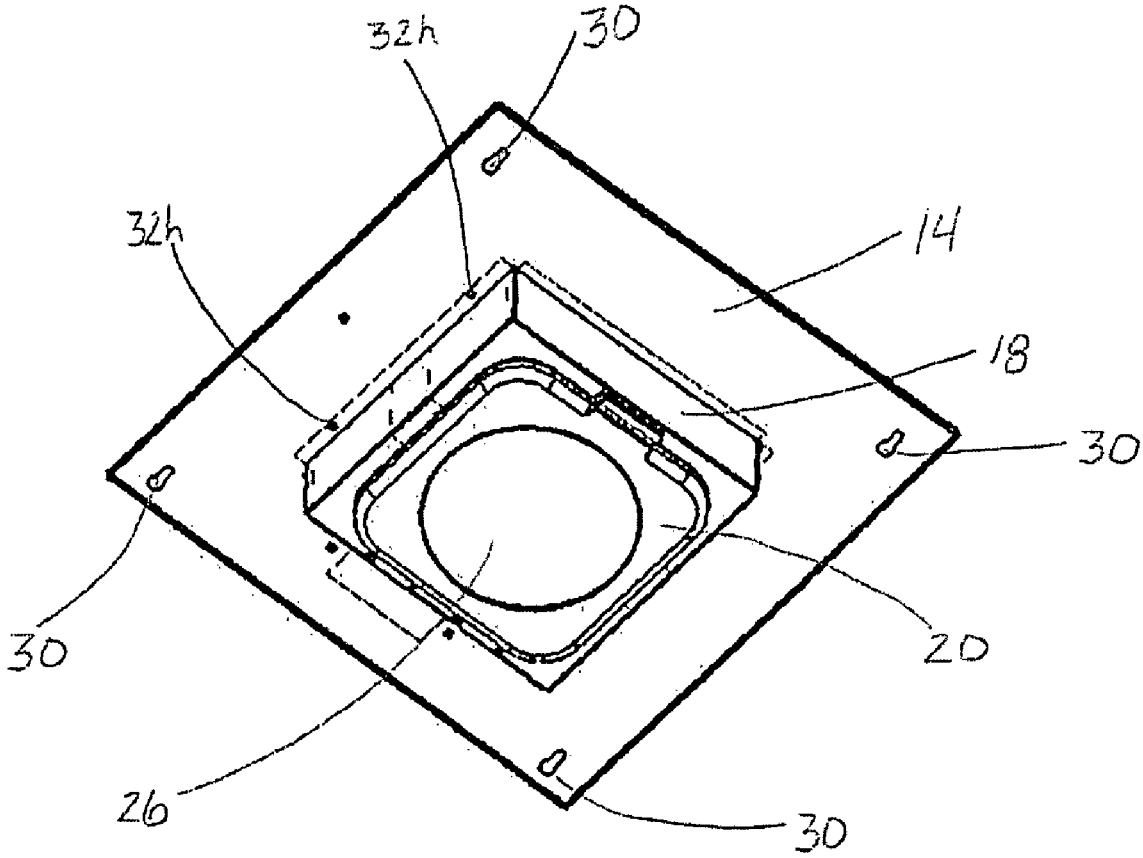
FIG. 2 is a perspective drawing of a face plate of the luminaire embodiment of FIG. 1 viewed from below the plate.
Figure 3:
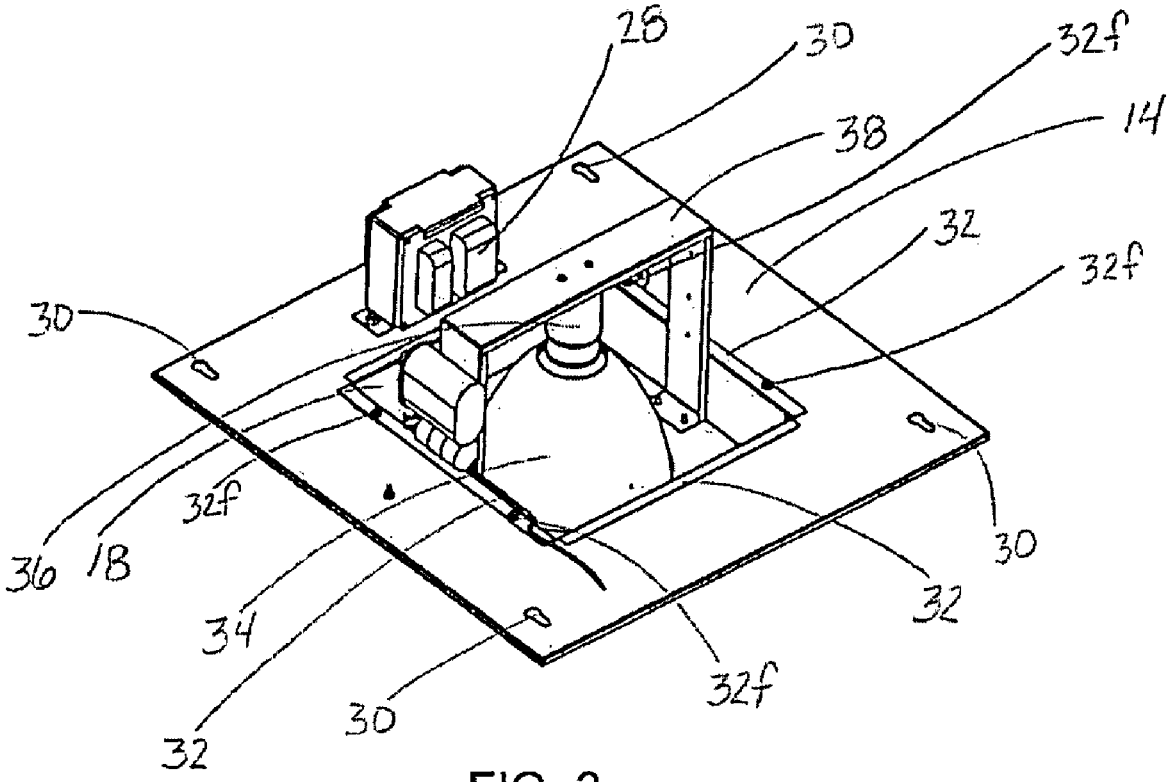
FIG. 3 is a perspective drawing of a face plate of the luminaire embodiment of FIG. 1 viewed from above the plate.

FIGS. 2 and 3 are perspective drawings of face plate 14 of luminaire 10. FIG. 2 is viewed from below face plate 14, and FIG. 3 is viewed from above face plate 14. Face plate 14 includes four monitoring holes 30 for fasteners 16. Note that this embodiment shows four holes 30 and fasteners 16 but some embodiment of this inventive luminaire may include fewer than four holes and fasteners. A transformer or ballast 28 is mounted on the top side of face plate 14. Lamp component housing 18 is also mounted on face plate 14 by means of four mounting flanges 32, fasteners 32*f* (four shown) and mounting holes 32*h* (two shown). Also assembled with lamp component housing 18 are a lamp reflector 34, a lamp socket 36, and a socket support 38. The lamp installed in lamp socket 36 is not shown. Other components which may be assembled with lamp component housing 18 are also not shown in FIGS. 2 and 3.

Figure 4:
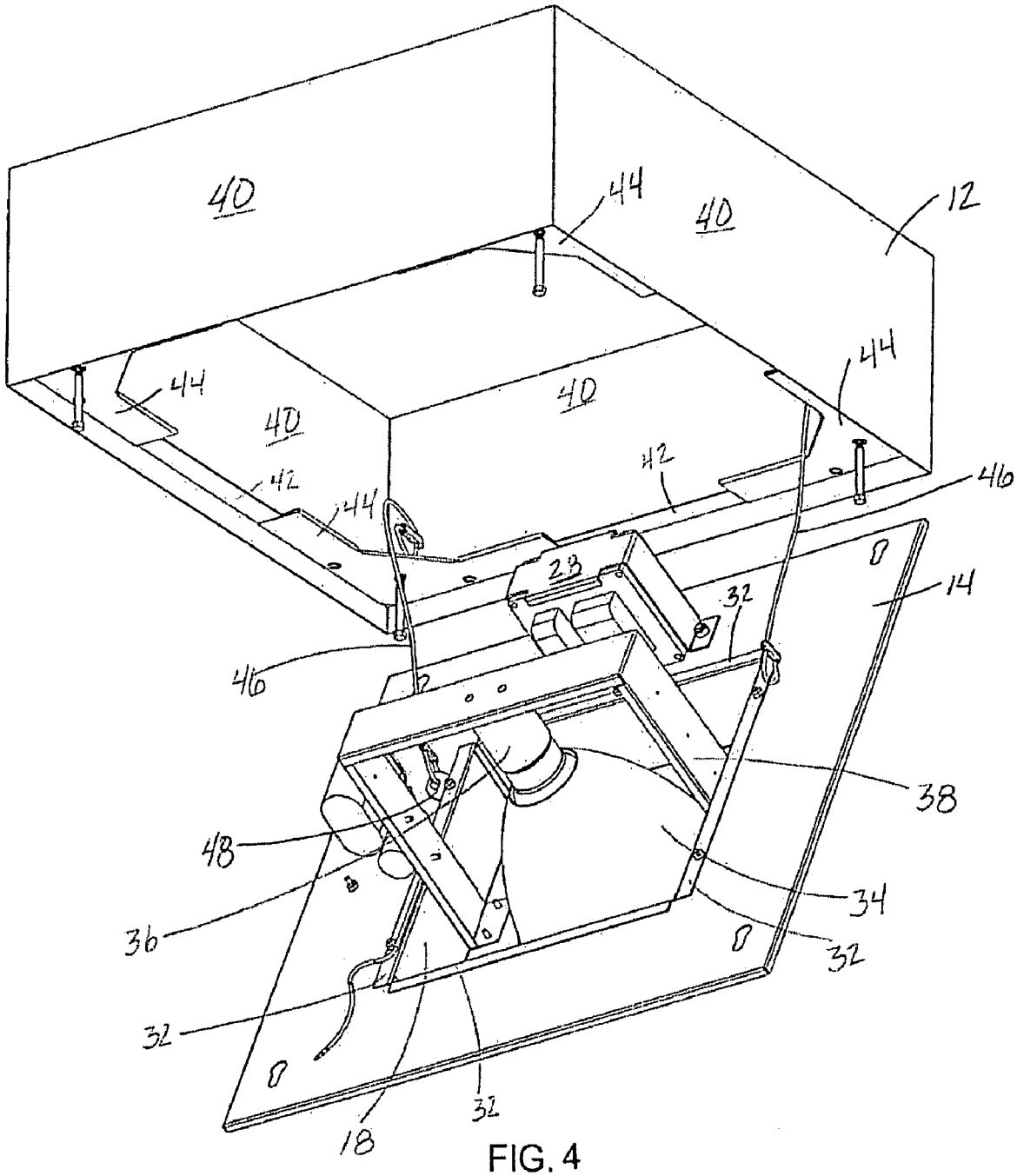
FIG. 4 is a perspective drawing of the luminaire embodiment of FIG. 1 shown with the face plate unfastened from the housing.
Figure 5:
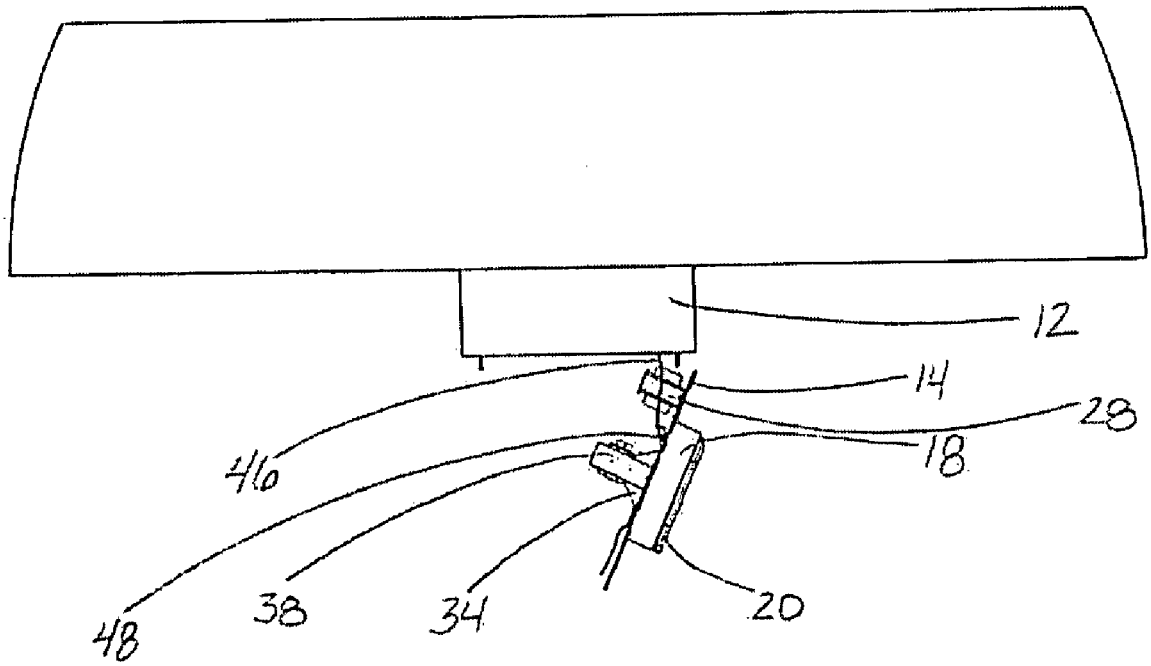
FIG. 5 is a side elevation schematic drawing of the luminaire embodiment of FIG. 1 shown with the face plate unfastened from the housing.
Figure 6:
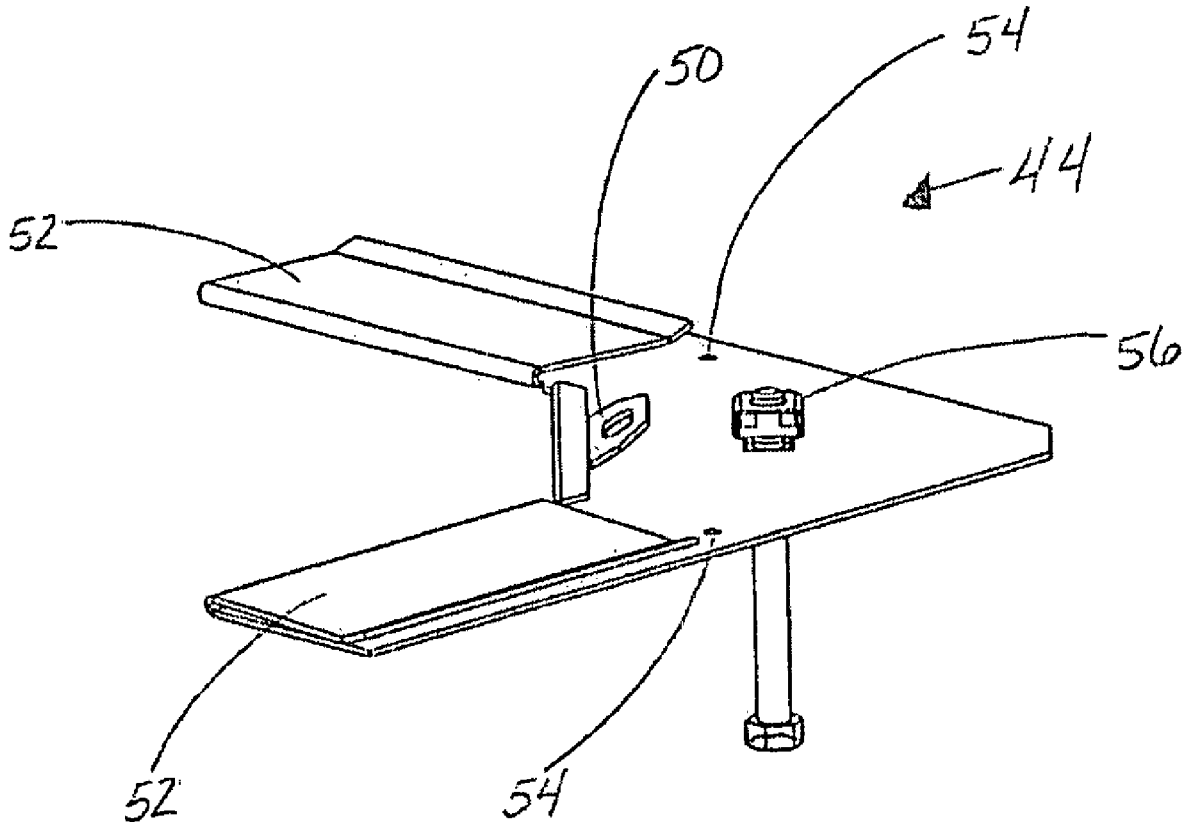
FIG. 6 is a perspective drawing of a support bracket of the luminaire embodiment of FIG. 1.

FIGS. 4 and 5 illustrate two views of face plate 14 in an open position with respect to housing 12 of luminaire 10. Housing 12 includes four side walls 40 as part of the box-like structure of housing 12. Four inwardly-facing ledges 42 (two visible in FIG. 4) are attached to side walls 40, one to each side wall 40, near the bottom of and running parallel to each side wall 40. Ledges 42 may be formed integrally with side walls 40 (such as folded sheet metal structures) or may be attached thereto using any suitable fastening technique.

Figure 7:
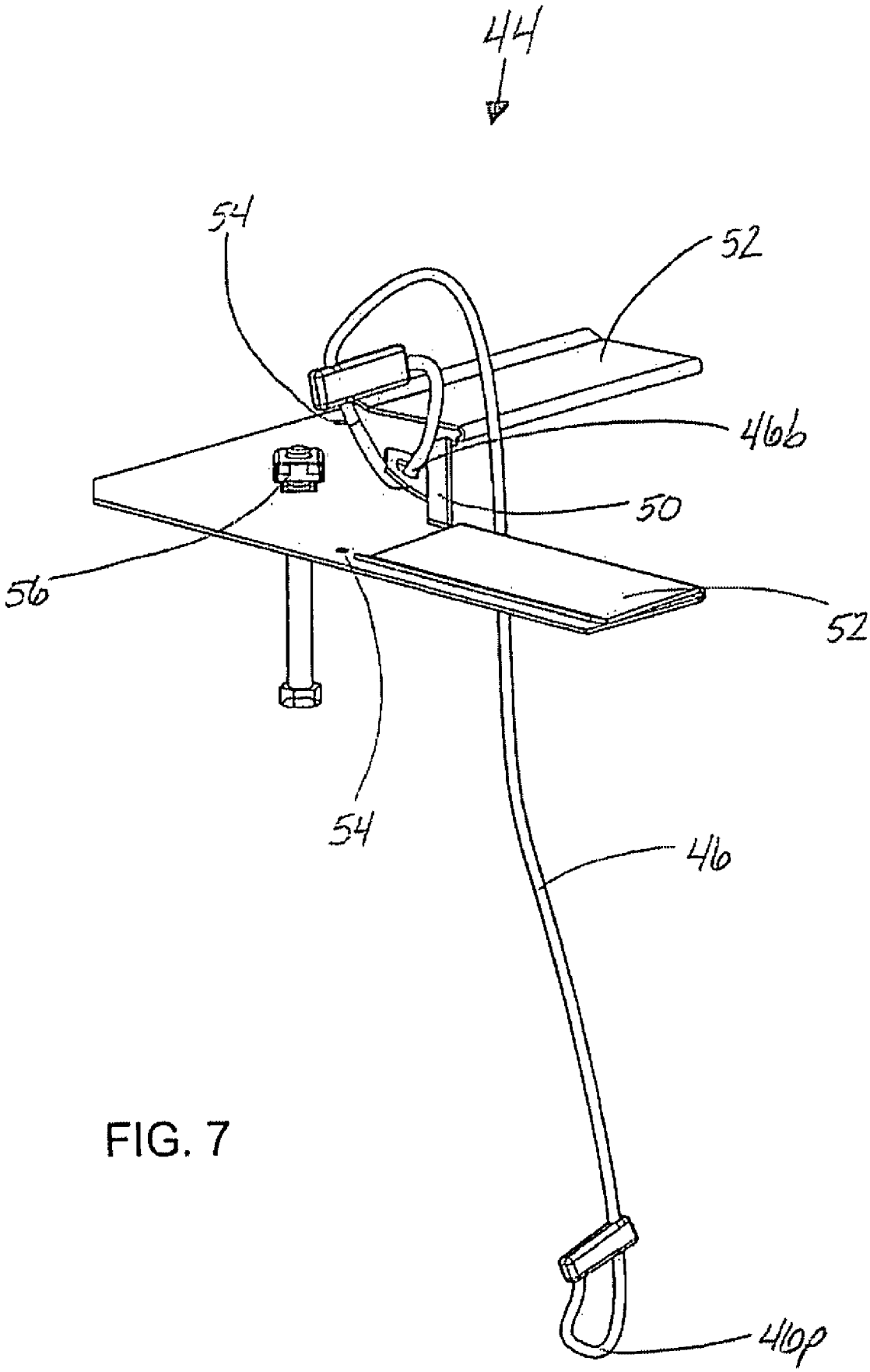
FIG. 7 is a perspective drawing of a support bracket and a hanging tether of the luminaire embodiment of FIG. 1.

Four support brackets 44 (all four shown in FIG. 4) are installed on ledges 42 in the four corners of housing 12. Each of two of brackets 44 have one end 46*b* (also referred to as a proximal end) of a hanging tether 46 attached thereto. The other end 46*p* (also referred to as a distal end) of each hanging tether 46 is attached to two flange attachment tabs 48 (shown in FIGS. 4 and 7). Tabs 48 may be formed as integral parts of flanges 32 or may be attached separately by fasteners 32*f* or by another suitable fastening technique which connects tethers 46 to face plate 14 or to another element assembled thereto. A preferred embodiment of tether 46 would include a spring loaded snap clip for easier attachment to the face plate brackets.

Referring to FIGS. 6 through 9 for more detail on support brackets 44, each support bracket 44 includes two ledge slots 52 into which ledges 42 are place when brackets 44 are assembled into housing 12. Brackets 44 are preferably formed out of sheet metal but may be made of any other suitable material. Bracket 44 also includes a bracket attachment tab 50 to which end 46*b* of hanging tether 46 is attached. Any other suitable attachment point for end 46*b* may be formed in or attached to bracket 44 in order to provide sufficient strength of attachment to hold the weight of face plate 14 and all of the components attached thereto through one or more hanging tethers 46. Hanging tethers 46 can be made of braided metal, cable or any other suitably-strong flexible material of which tethers can be formed.

Figure 8:
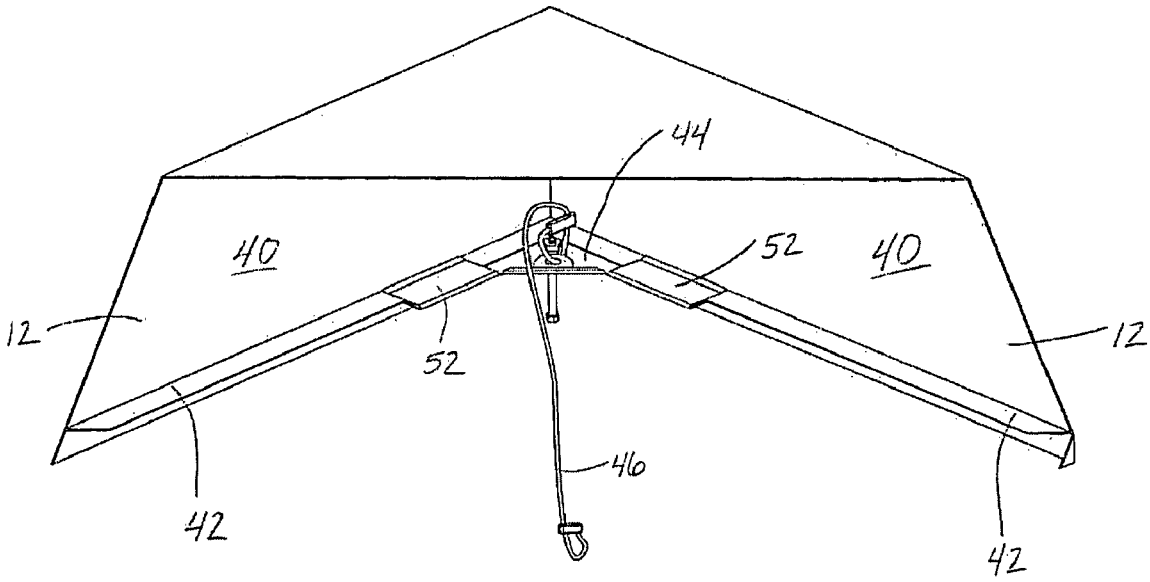
FIG. 8 is a perspective drawing of an installed support bracket and a hanging tether of the luminaire embodiment of FIG. 1.
Figure 9:
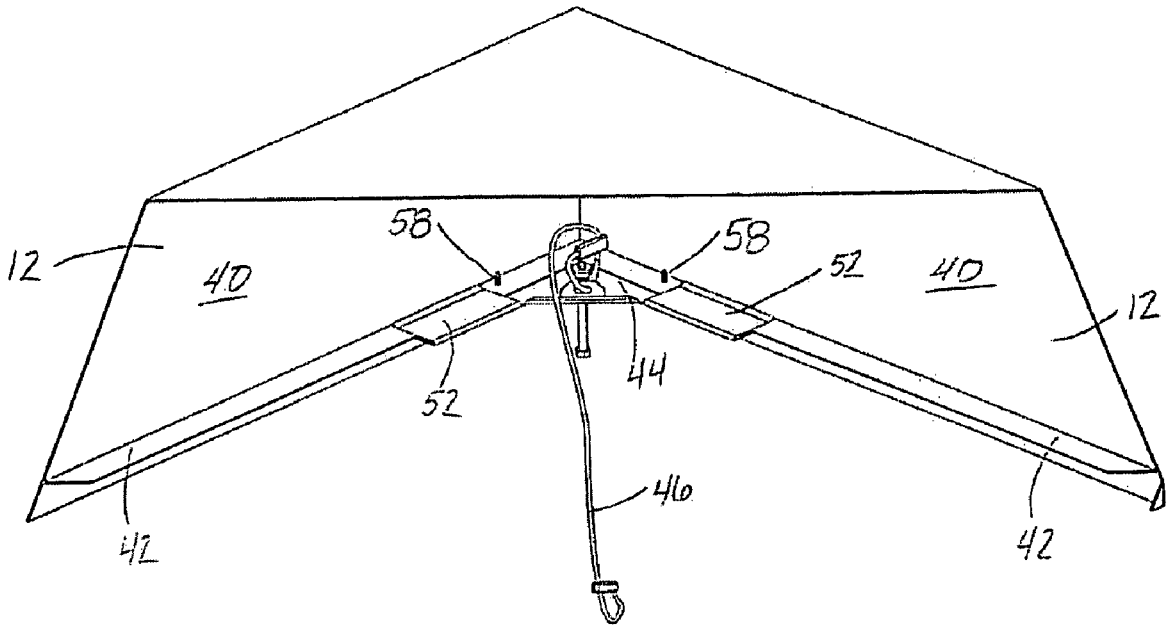
FIG. 9 is a perspective drawing of an installed support bracket with fasteners and a hanging tether of the luminaire embodiment of FIG. 1.
Figure 10:
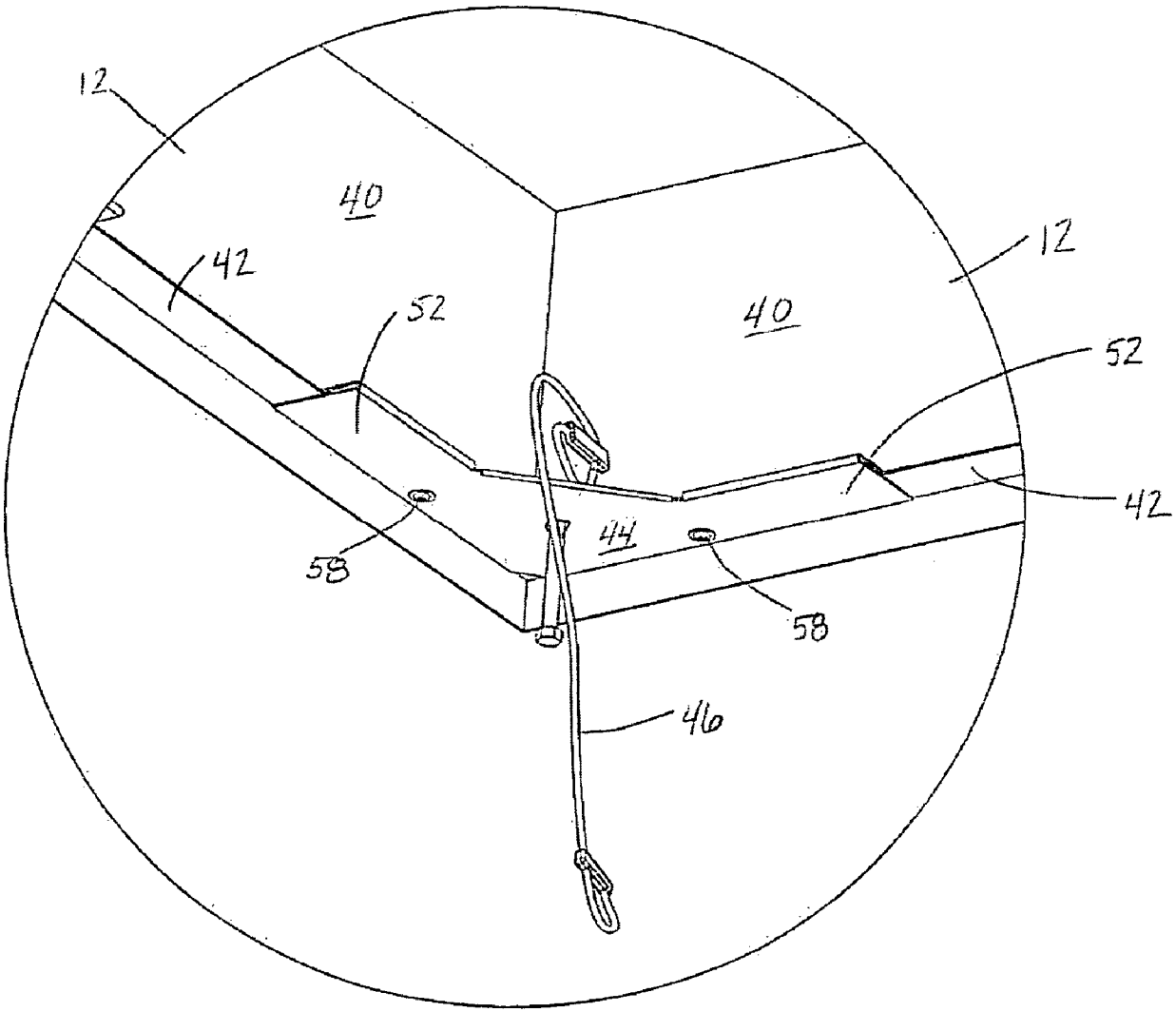
FIG. 10 is a perspective drawing of an installed support bracket and a hanging tether.

FIGS. 8-10 show bracket 44 in place on ledges 42 of housing 12. FIGS. 9 and 10 additionally illustrate two fasteners 58 used to secure bracket 44 to ledges 42 through holes 54.

Figure 11:
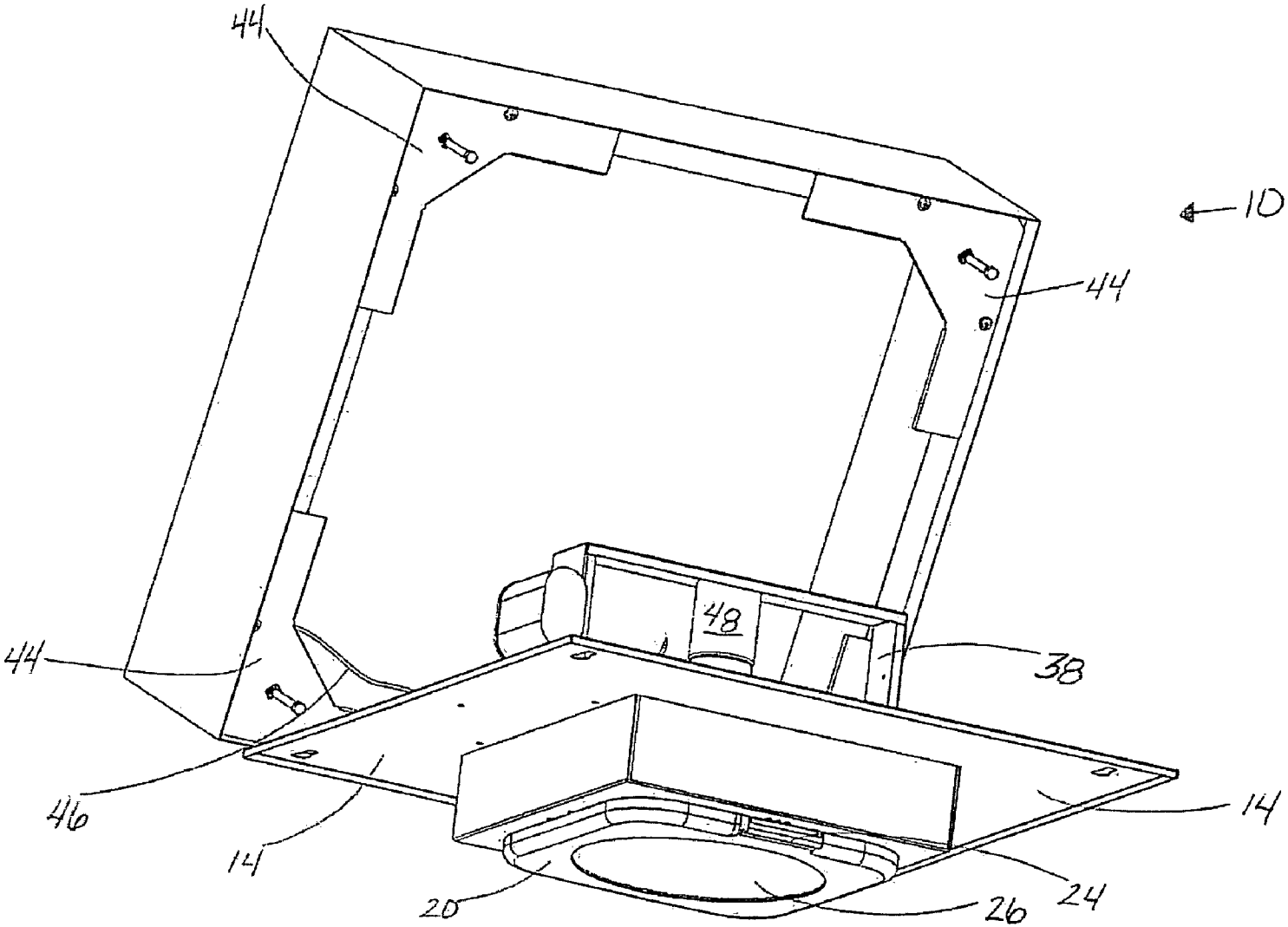
FIG. 11 is a side perspective view of the luminaire embodiment of FIG. 1, showing the face plate with fixture components installed. The face plate is hanging from two hanging tethers, in position for installation or repair.
Figure 12:
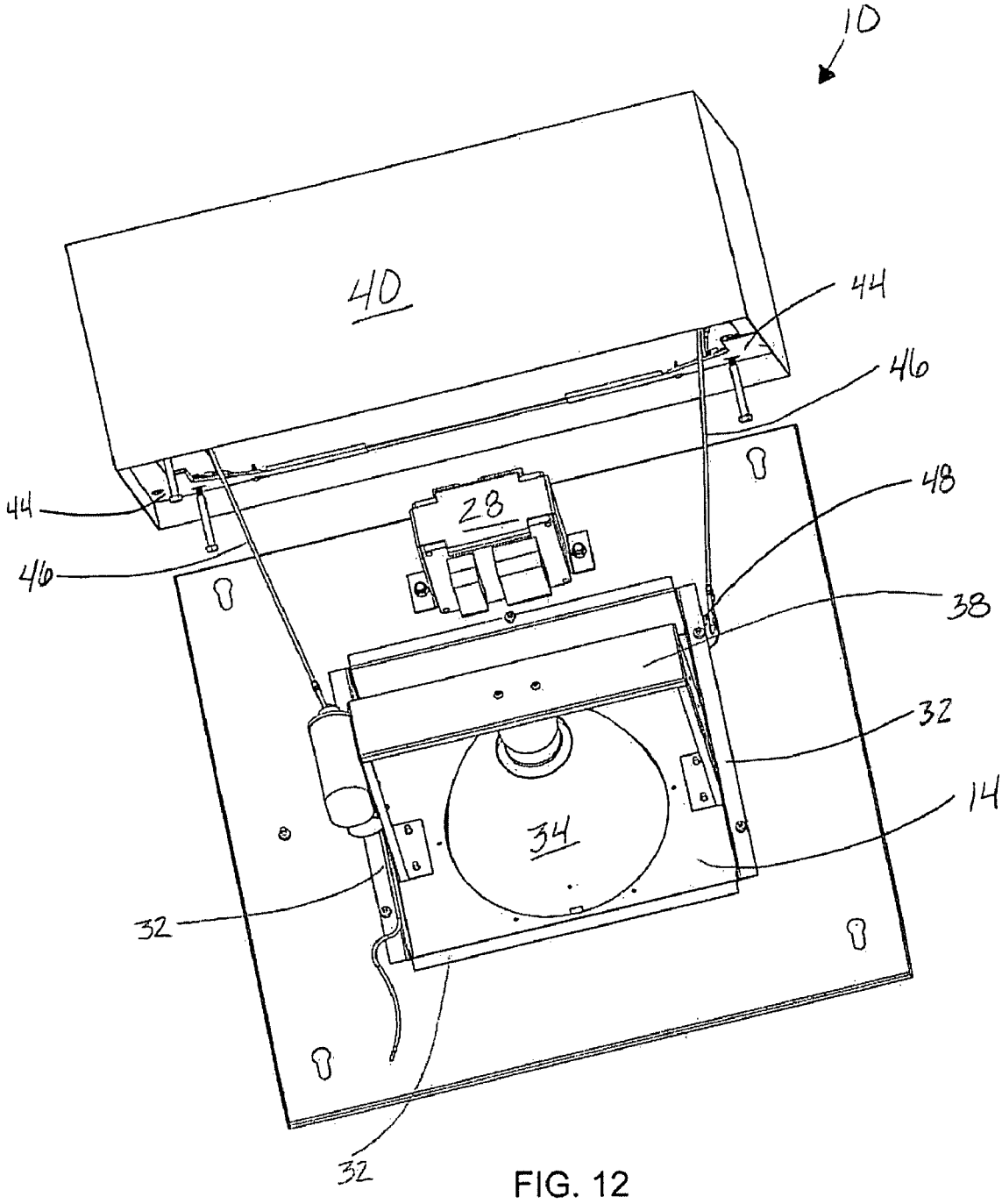
FIG. 12 is a perspective view of the luminaire embodiment shown in FIG. 11, showing the face plate supported by two hanging tethers.

FIGS. 11 and 12 illustrate inventive luminaire 10 and the method by which it is used to effect installation or repair of such luminaire. FIG. 12 illustrates tether 46 attached to tab 50 of bracket 44 as well as the securing of bracket 44 as described in the previous paragraph. FIGS. 11 and 12 illustrate faceplate 14 hanging by two tethers 46 in position for installation or repair. While face plate 14 is in such position, a technician has access to the inside of luminaire 10 thus freeing both hands to carry out the necessary installation or repair steps without having to support the weight of face plate 14 and any additional components attached thereto.

FIG. 12 illustrates face plate 14 in an approximately horizontal orientation supported by tethers 46. This places face plate 14 in an orientation which allows it to be easily lifted into place in proper alignment for final assembly of luminaire 10. Fasteners 16 (one shown in FIG. 1) are used to secure face plate 14 in position on housing 12.

While the principles of this invention have been described in connection with specific, embodiments, it should be understood clearly that these descriptions are made only by way of example and are not intended to limit the scope of the invention. For example, depending on the weight of the face plate and the components attached thereto, only one hanging tether may be required to hold the face plate in position for installation or repair. It may also be possible to use two support brackets on opposite corners of the housing and to secure the face plate in place with only two fasteners. Further, the housing need not be square or rectangular but can be of any shape allowing the securing of suitably-configured support brackets to the inwardly-facing ledge or ledges of the housing.

The invention claimed is:

1. A retrofit luminaire assembly adapted for downward illumination and having a housing with inwardly-directed ledges near the lower edges of the housing, comprising:

at least two support brackets secured to at least one of the ledges;

a face plate removably secured to the brackets on the lower side of the housing, the face plate adapted to hold lighting fixture components; and first and second hanging tethers each attached at its proximal end to a separate one of the support brackets along one side of the housing, the first and second tethers being secured at their distal ends to opposite ends of one side of the faceplate, wherein when the face plate is removed from the brackets, the face plate hangs freely held by the tethers to allow free access to the inside of the luminaire.

2. A method of installing a retrofit luminaire assembly adapted for downward illumination and having a housing with inwardly-directed ledges near the lower edges of the housing, the method comprising the steps of:

providing at least two support brackets;

securing the two support brackets to at least one ledge;

providing a face plate adapted to hold lighting fixture components;

providing first and second hanging tethers each attached at its proximal end to a separate one of the support brackets along one side of the housing, the first and second tethers being secured at their distal ends to opposite ends of one side of the faceplate; and securing the face plate to the brackets with the tethers such that the face plate hangs freely without further support during installation.

* * * * *